United States Patent [19]

Mann

[11] 3,988,009

[45] Oct. 26, 1976

[54] BOARD-TYPE FENCE

[76] Inventor: William C. Mann, P.O. Box 263, Broken Arrow, Okla. 74012

[22] Filed: Mar. 10, 1975

[21] Appl. No.: 556,641

Related U.S. Application Data

[63] Continuation-in-part of Ser. No. 388,614, Aug. 15, 1973, Pat. No. 3,892,056, which is a continuation-in-part of Ser. No. 319,216, Dec. 29, 1972, Pat. No. 3,892,387.

[52] U.S. Cl. ..... 256/24

[51] Int. Cl.[2] ..... E04H 17/16

[58] Field of Search ..... 256/19, 21, 22, 24, 256/25

[56] References Cited

UNITED STATES PATENTS

| | | | |
|---|---|---|---|
| 2,545,845 | 3/1951 | Du Batto et al. | 256/19 |
| 2,706,838 | 4/1955 | Sears | 256/24 |
| 2,721,727 | 10/1955 | Eddy | 256/19 |
| 3,451,657 | 6/1969 | Roberts | 256/19 |

*Primary Examiner*—Werner H. Schroeder
*Assistant Examiner*—Doris L. Troutman
*Attorney, Agent, or Firm*—William S. Dorman

[57] ABSTRACT

A board-type fence which is of substantially identical appearance on both sides and which eliminates the need for nails in the construction thereof. The fence comprises a plurality of fence panels and fence posts. Each fence panel is constructed by passing a pair of spaced parallel rods through a predetermined number of fence boards arranged in aligned side-to-side relation with the rod ends projecting outwardly from the sides of each panel. Each fence post is provided with two pairs of holes that are horizontally offset from each other, the holes of each set being spaced apart a distance exactly equal to the rod spacing of each panel; thus, with regard to a given fence post, the rod ends of a first panel will project into one pair of spaced holes in that fence post whereas the rod ends of the other fence panel will project inwardly into the other pair of spaced holes on the opposite side of the fence post.

4 Claims, 6 Drawing Figures

BOARD-TYPE FENCE

CROSS-REFERENCE TO RELATED APPLICATION

This application is a continuation-in-part of application Ser. No. 388,614, filed Aug. 15, 1973, for "METHOD OF CONSTRUCTING A BOARD-TYPE FENCE", now U.S. Pat. No. 3,892,056, issued on July 1, 1975, which in turn, is a continuation-in-part of application Ser. No. 319,216, filed on Dec. 29, 1972, and entitled "FENCE STRUCTURE," now U.S. Pat. No. 3,892,387, issued July 1, 1975.

BACKGROUND OF THE INVENTION

1. Field of the Invention

This invention relates to a fence structure and, more particularly, to a nail-less fence structure of substantially identical appearance on both sides thereof.

2. Description of the Prior Art

Wood or board fences are in widespread use today, and these usually comprise a plurality of vertically spaced, horizontally extending boards or cross-rails secured to one face or side of the fence for securing the usual upright fence slats or pickets together. As a result, one side of the fence is substantially unencumbered, and of a relatively attractive appearance, whereas the other face or side is unsightly. The upright fence elements or slats are usually secured to the horizontally extending boards by nails or the like; normal wheather conditions generally cause the nails to rust, and the rust or corrosion of the nails frequently stains or otherwise mars the appearance of the attractive side. In addition, the horizontally extending boards or cross-rails provide a "ladder" type structure on one side of the fence which small children may climb, which not only enables them to scale the fence, but also frequently results in mishaps which cause personal injury to the child.

SUMMARY OF THE INVENTION

The present invention contemplates a novel fence structure which is particularly designed and constructed for overcoming the foregoing disadvantages. The resulting fence is of a substantially identical attractive appearance on both sides, and is assembled or secured together in a manner which completely eliminates the need for nails, and the like. The fence structure comprises a plurality of fence sections secured together in a side-by-side or end-to-end relationship for providing a fence of substantially any desired length and for substantially any surface contour of the area being fenced. Each fence section comprises a fence panel or module attached between a pair of end posts. Each fence panel or module comprises a plurality of fence elements or fence boards which are suspended on a pair of elongated rod members which extend transversely through the fence boards and into the end posts. The rod elements, therefore, are entirely encased within the various fence elements described above, thus reducing or substantially eliminating any staining or other marring of the attractive faces of the fence structure. Each fence panel or module is suspended between a pair of fence posts and is secured thereto through holes which are horizontally offset from the holes provided in the fence posts for the adjacent fence modules or panels secured to the opposite sides thereof.

The connecting rod means of the present invention eliminates the need for horizontally extending board members or cross-rails as used in present-day fences of this type, and thus eliminates the "ladder" type construction and the inherent disadvantages thereof. The novel fence structure is of a simple economical construction.

More particularly, the present invention involves the selection of a plurality of identically sized fence boards and a plurality of substantially identically sized fence posts. Each fence panel is assembled by arranging a predetermined number of fence boards in aligned side-by-side relation, passing a pair of spaced parallel rods through aligned holes in the fence boards so that the rod ends project outwardly from the sides of each panel. The rods in each panel are spaced apart a predetermined distance from each other. The fence posts are provided with two pairs of holes, the pairs being horizontally offset from each other. The holes of each pair are spaced apart a distance equal to the predetermined distance between the rods. Thus, when erecting a fence using the present invention, a first fence post is inserted in the ground at the desired level, one fence panel is attached to the fence post by inserting the rods in one pair of holes in the fence post. A second post is inserted in the ground at the opposite end of this first section and attached thereto in substantially the same manner. For the purpose of attaching a second fence section to the opposite side of the second post, a second fence panel is installed or attached to this second fence post by inserting the rod ends in the other pair of holes which are not occupied by the rods of the first section, and so forth until a fence of the desired length is achieved.

DESCRIPTION OF THE PREFERRED EMBODIMENT

Figure 1:
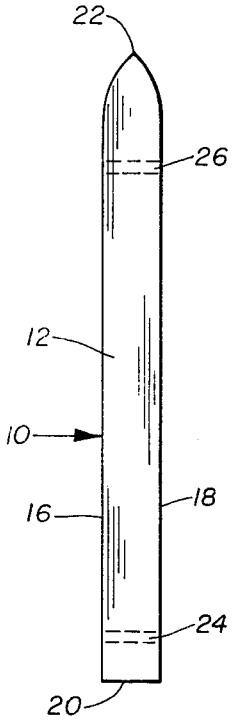
FIG. 1 is a side view of a fence board provided with holes for the purpose of assembling a fence panel.
Figure 2:
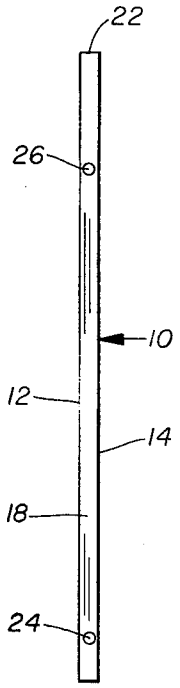
FIG. 2 is an end view of the fence board shown in FIG. 1.

Referring to the drawings in detail, FIGS. 1 and 2 show a fence board 10 which is defined as having a pair of elongated flat side surfaces 12 and 14 which are parallel to each other and separated from each other in accordance with the thickness of the board, a pair of narrow elongated side edges 16 and 18 parallel to each other and separated from each other in accordance with the width of the board and a pair of ends 20 and 22 separated from each other in accordance with the length of the board. The upper end 22 can be tapered or pointed as desired. The board 10 is further provided with two holes 24 and 26. These holes 24 and 26 extend across the width of the board perpendicular to the side edges and are spaced apart in parallel relation at a predetermined distance from each other for a purpose which will hereinafter appear.

Figure 3:
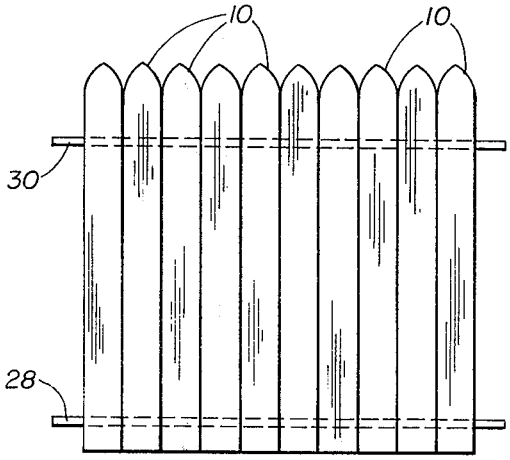
FIG. 3 is a side view on a slightly reduced scale of a fence panel assembly or modular construction.

FIG. 3 shows a fence panel constructed of a plurality of fence boards 10 mounted on a pair of elongated rods 28 and 30. A preselected number of boards 10 are received on the rods 28 and 30 so that the rods pass through within the openigs 24 and 26, respectively, of the boards. The diameter of the rods 28 and 30 are preferably substantially equal to the diameter of the openings 24 and 26 so as to make a reasonably tight fit. After the predetermined number (for the sake of illustration only, this number is ten) have been received or impaled on the rods 28 and 30, the resulting panel or module is produced as shown in FIG. 3. The ends of the rods 28 and 30 project outwardly from the panel structure of FIG. 3.

Figure 4:
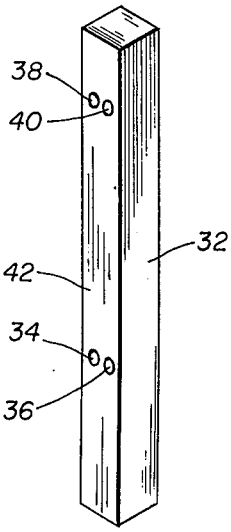
FIG. 4 is a perspective view of a fence post.

The remaining element of the ultimate fence construction is the fence post 32 shown in FIG. 4. This fence post is preferably rectangular in shape and is longer than the length of the boards 10. The fence post is provided with four holes 34, 36, 38 and 40, which extend all the way through the post 32 substantially parallel to each other in a surface 42, which is preferably somewhat wider than the thickness of the boards. The holes 34 and 38 are spaced from each other at a distance equal to the distance between the rods 28 and 30 and are designed to receive the rods 28 and 30 of a fence panel such as shown in FIG. 3 on one side of the post 32. The holes 36 and 40 are likewise separated from each other a distance equal to the spacing between the rods 28 and 30 and are also designed to receive the ends of the rods of another fence panel such as shown in FIG. 3 on the opposite side of the post 32. It should be noted, however, that the holes 36 and 40 are offset horizontally (to the right) from the holes 34 and 38 for a purpose which will hereinafter appear. The amount of offset is equal to or slightly less than the thickness of a board 10.

Figure 5:
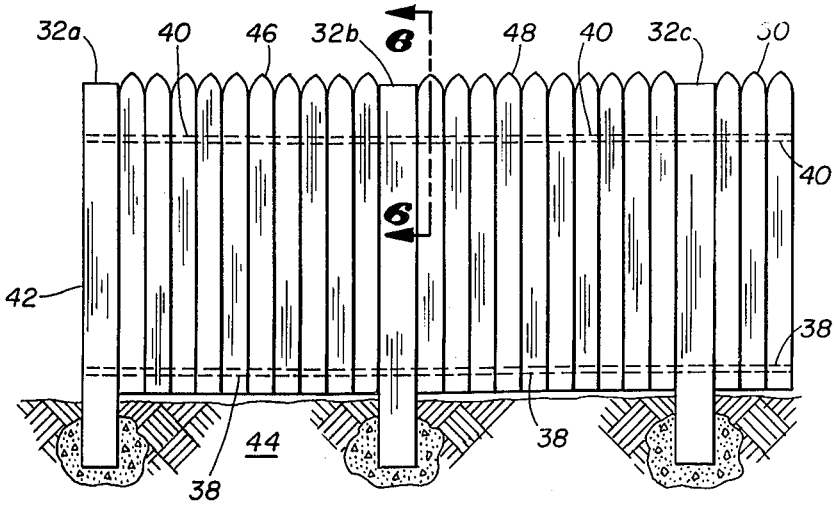
FIG. 5 is a side view of a fence constructed from the fence panels and fence posts of the present invention.

Turning now to a consideration of FIG. 5, a first fence post 32*a* is inserted in a hole previously dug in the ground 44. Care must be taken to see that the hole is not so deep that the openings 34 and 36 would be too close to the ground so as to prevent attachment of the fence panel. At this point, a first fence panel 46, constructed in the manner shown in FIG. 3, is placed adjacent the right-hand side of the post 32*a* and the ends of the rods 28 and 30 are inserted into the holes 34 and 38 or 36 and 40. For the purpose of this explanation, it will be assumed that the rods 28 and 30 are received in the holes 36 and 40, respectively. It may be necessary to bang on the boards 10 or on the rods 28 and 30 to insure a tight fit of the fence section against the fence post 32*a*. At this time, a second fence post 32*b* is inserted into a hole in the ground 44 conveniently dug adjacent the right-hand end of the fence section. Again, the right-hand end of the rod 28 and the right-hand end of the rod 30 are inserted in the openings 36 and 40 of the post 32*b* and the latter may be banged with a sledge hammer to insure a proper fit. Of course, the right-hand ends of the rods 28 and 30 could be inserted into the holes 34 and 38, respectively, but it is preferred to use the holes 36 and 40 so that the fence panel will be at right angles to the posts 32*a* and 32*b*. The holes in the ground for the posts 32*a* and 32*b* can now be filled in with mortar or dirt as desired, or this operation can be performed after the fence has been completely erected.

After the post 32*b* has been secured against the fence section attached between the posts 32*a* and 32*b*, another fence section or panel 48, substantially identical to the fence panel 46, is brought up adjacent the right-hand side of the post 32*b* and the rod ends 28 and 30 are now inserted in the holes 34 and 38. Again, a sledge hammer may be desirable to assist in banging the boards and/or rods to provide a snub fit. After the second fence section 48 has been attached to the right-hand portion of the post 32*b*, a third fence post 32*c* is inserted in a hole in the ground 44 adjacent the right-hand end of the fence section and, again, the fence post 32*c* is attached to the second fence section by inserting the rod ends thereof into the holes 34 and 38 of the fence post 32*c*. After the third fence post 32*c* has been firmly secured against the second fence section, a third fence section 50 (only part of which is shown in FIG. 5) can now be installed against the right-hand portion of the fence post 32*c*, by inserting the rod ends thereof into the holes 36 and 40 of the fence post 32*c*.

Figure 6:
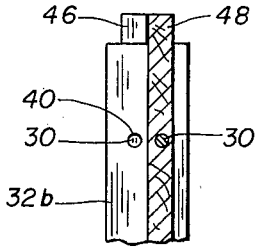
FIG. 6 is a fragmentary sectional view taken along section line b—6 of FIG. 5.

FIG. 6, taken into consideration with FIGS. 4 and 5, shows the advantage of having the holes 34 and 38 horizontally offset from holes 36 and 40. If we look along the upper portion of the post 32*b* in the direction of the section line 6—6, we will be able to see the end of the rod 30 of the fence panel 46 received within the hole 40 of the fence post; preferably, the end of the rod 30 of the fence section 46 is flush with the right-hand surface of the fence post 32*b;* however, this end of the rod 30 could project slightly outwardly beyond the post or it could be recessed slightly within the opening 40. The rod 30 of the fence panel 48 (both of which are shown in section in FIG. 6) would be received in the opening 38 (not shown in FIG. 6) as previously described. If one were to look at the left-hand side of the fence post 32*b* (in a direction opposite from the section line 6—6 and at the rear of the fence), one would see the rod 30 of the fence section 48 received within the opening 38. The same considerations hold true for the lower rods 28 of the fence sections 46 and 48. The upper portion of the fence post 32*b* is shown only, for the sake of convenience.

If it is desired to replace the fence panel 46, or one of the fence boards 10 therein, it would not be necessary to take down the fence or even to remove one of the fence posts; using another rod or tool (not shown) of the same or slightly smaller diameter than the rod 28 or 30, the rod 30 is driven towards the left, for example (referring to FIG. 5). If one wished to remove the entire fence section 46, he would drive the rod 30 (and rod 28 as well) all the way through and beyond the left-hand fence post 32b. Thereafter the boards 10 could be replaced with a new set of boards 10 and the rods 28 and 30 would then be driven through the post 32*a* in the reverse direction towards the post 32*b*, while impaling the boards 10 individually on the rods 28 and 30 as the latter are driven back towards the right. If it were merely desired to replace a single fence board 10, one would drive the rods 28 and 30 towards the left (or towards the right, if the offending board 10 were closer to the fence post 32*a*) until the rods 28 and 30 were driven past, or to, whatever fence post 10 it would be desired to replace; the board 10 would then be replaced and the remaining boards 10 would be again impaled on the rods 28 and 30 as they are driven back towards the right.

From the foregoing, it should appear that alternate fence sections, such as fence sections 46 and 48, are horizontally offset from each other; however, this would not make the fence unattractive, nor would this relationship be particularly noticeable from a distance.

Whereas the present invention has been described in particular relation to the drawings attached hereto, it should be understood that other and further modifications, apart from those shown or suggested herein, may be made within the spirit and scope of this invention.

What is claimed is:

1. A board-type fence constructed without nails and bolts comprising a plurality of substantially identical fence panels connected between spaced fence posts, each fence panel being constructed from a plurality of substantially identically sized fence boards, each fence board being defined as having a pair of elongated flat surfaces which are parallel to each other and separated from each other in accordance with the thickness of the board, a pair of narrow elongated sides parallel to each other and separated from each other in accordance with the width of the boards, and a pair of ends separated from each other in accordance with the length of the board, each fence board being provided with a pair of parallel bores extending transversely across the width of the board and spaced apart a predetermined distance, each fence panel also including a pair of parallel rods spaced apart said predetermined distance and passing through the transversely extending bores of said plurality of fence boards when the latter are arranged in aligned side-to-side relation so that the rod ends project outwardly from the sides of each panel, each fence post being provided with a first pair of vertically spaced holes therethrough for receiving the rod ends of one end of a fence panel on one side of said fence post, each fence post also being provided with a second pair of vertically spaced holes therethrough for receiving the rod ends at the end of a second fence panel connected to an opposite side of said fence post from said first fence panel, said second pair of vertically spaced holes being horizontally offset and parallel to said first pair of vertically spaced holes.

2. A board-type fence as set forth in claim 1 wherein said second pair of vertically spaced holes are offset from said first pair of spaced holes at a distance no greater than the thickness of the fence boards measured at right angles to the fence panel.

3. A board-type fence constructed without nails and bolts comprising a plurality of substantially identical fence panels connected between spaced fence posts, each fence panel being constructed from a plurality of substantially identically sized fence boards, each fence board being defined as having a pair of elongated flat surfaces which are parallel to each other and separated from each other in accordance with the thickness of the board, a pair of narrow elongated sides parallel to each other and separated from each other in accordance with the width of the board, and a pair of ends separated from each other in accordance with the length of the board, each fence board being provided with a plurality of parallel vertically spaced bores extending transversely across the width of the board, each fence panel also including a plurality of spaced parallel rods passing through the transversely extending bores of said plurality of fence boards when the latter are arranged in aligned side-to-side relation so that the rod ends project outwardly from the sides of each panel, each fence post being provided with a first plurality of vertically spaced holes extending horizontally therethrough for receiving the rod ends of one end of a fence panel on one side of said fence post, each fence post also being provided with a second plurality of vertically spaced holes extending horizontally therethrough for receiving the rod ends at the end of a second fence panel connected to an opposite side of said fence post from said first fence panel, said second plurality of vertically spaced holes being horizontally offset and parallel to said first plurality of vertically spaced holes.

4. A board-type fence as set forth in claim 3 wherein said second plurality of vertically spaced holes are offset from said first plurality of spaced holes at a distance no greater than the thickness of the fence boards measured at right angles to the fence panel.

* * * * *